United States Patent [19]

Troyer

[11] Patent Number: 4,807,526

[45] Date of Patent: Feb. 28, 1989

[54] ROLL-FEEDER LOADER AND METHOD THEREFOR

[75] Inventor: James Troyer, Phoenix, Ariz.

[73] Assignee: Phoenix Newspapers, Inc., Phoenix, Ariz.

[21] Appl. No.: 50,408

[22] Filed: May 18, 1987

[51] Int. Cl.[4] ..... B41F 3/82; B41F 3/46

[52] U.S. Cl. ..... 101/216; 101/153; 101/212

[58] Field of Search ..... 101/212, 216, 219, 153; 414/911, 748, 745

[56] References Cited

U.S. PATENT DOCUMENTS

| | | | |
|---|---|---|---|
| 324,840 | 8/1885 | Hill | 414/748 |
| 2,666,462 | 1/1988 | Richardson | 414/748 |
| 3,789,757 | 2/1974 | Motter et al. | 101/216 |
| 3,876,087 | 4/1975 | Osta | 101/216 |
| 4,535,882 | 8/1985 | Malivoir | 414/745 |

*Primary Examiner*—Edgar S. Burr
*Assistant Examiner*—Huong A. Pham
*Attorney, Agent, or Firm*—Harry M. Weiss

[57] ABSTRACT

An apparatus and method for loading a mandrel-mounted roll into an uncoiler, which utilizes a pair of rotating contoured plates for engaging the ends of the mandrel. The rotating plates each having a lifting hook, a placing hook and a cam surface between the hooks, with the cam surface contoured to clear obstructions between the loading position and the production position as the plates rotate to translate the respective hooks therebetween.

4 Claims, 1 Drawing Sheet

ROLL-FEEDER LOADER AND METHOD THEREFOR

BACKGROUND OF THE INVENTION

1. Field of the Invention

This invention relates to the printing industry, and, more specifically, to an apparatus and method for loading rolls of paper into a roll-feeder or uncoiler for a printing press.

2. Description of the Prior Art

In the past, mankind enthusiastically embraced printing as a form of communication. The public's thirst for knowledge motivated those engaged in field of fabricating printing equipment to develop larger and faster presses.

The earliest printing presses sequentially printed single sheets. The modern printing press has evolved into gigantic, complex device incorporating a wide variety of mechanical, hydraulic and electrical systems.

Among the other improvements to the printing press, the introduction of roll-feeding paper eliminated the rote task of handling individual sheets. The roll-feeding technique consisted of mounting a roll of paper on an axle, or mandrel, and securely supporting the roll-mandrel combination on saddles or bearings at the feed-end of the press. Drive rolls engaged the supporting mandrel to rotate the roll and feed the paper. Brake shoes were positioned to grip the mandrel to slow the feed as required. A tensioner totally contacted the surface of the roll, maintaining the tension of the paper on the roll despite variations in press speed. The roll-feeding mechanism could be incorporated into the structure of the printing press, or could be a free-standing device aligned with the press.

High-volume publishers, such as those printing newspapers and magazines, universally adopted the roll-feeding technique. With the growth in printing volume, larger rolls of paper, often weighing tons, came into common use. The larger rolls minimized the down-time for reloading the press with paper.

However, the typical gigantic printing press enveloped the actual mounting position for the paper roll. The great weight of the rolls required precise care in the placement of the mandrel in the supporting saddles. The restricted access to the mounting position for the paper roll limited utilization of conventional material handling devices such as cranes or forklifts. As a result, the technological marvel of the modern, high-speed printing press continued to require significant "bull-work" to lift and position the paper roll within the feed mechanism of the press. Since the typical large press had only a single roll-feed position, the problems involved in mounting a fresh roll of paper caused a delay, reducing the overall efficiency of the press.

A need existed for an apparatus or method to speed the loading of a paper roll into a printing press. In particular, a need existed for a way to alleviate the heavy physical labor required to load the roll. More specifically, a need existed for an apparatus or method to lift a roll of paper from a location below and adjacent to the press, shift the roll laterally to a position above the upper limits of the mounting saddles, and to further gently lower the mandrel accurately and precisely into the mounting saddles.

SUMMARY OF THE INVENTION

In accord with one embodiment of this invention, it is an object to provide an apparatus to lift and shift a mandrel-mounted roll of paper into the feed position of a printing press.

It is another object to provide a rocker-mechanism to lift, translate, and lower a mandrel-mounted roll of paper from a loading position to a feed, or production, position within a printing press.

It is a further object to provided a pair of opposed, pivotally mounted lifting plates having a generally concave edge disposed to: hook opposed ends of a mandrel supporting a roll of paper with an end of the concavity as the plates begin to pivot; roll or slide the ends of the mandrel across the bottom of the concavity as the plates continue to pivot; catch the ends of the mandrel as the plates continue to pivot; and lower the ends of the mandrel into the supporting saddles of a printing press as the plates complete their pivoting motion.

It is yet another object to provide a method for lifting and shifting a mandrel-mounted roll of paper into the feed position of a printing press.

It is still another object to provide a method for lifting, translating, and lowering a mandrel-mounted roll of paper from a loading position to a feed, or production, position within a printing press.

It is an object to provide a method of hooking opposed ends of a mandrel supporting a roll of paper with a pair of opposed, pivotally mounted concave-edged plates as the plates begin to pivot; rolling or sliding the ends of the mandrel across the bottom of the concavity as the plates continue to pivot; catching the ends of the mandrel as the plates continue to pivot; and lowering the ends of the mandrel into the supporting saddles of a printing press as the plates complete their pivoting motion.

DESCRIPTION OF THE PREFERRED EMBODIMENTS

In accordance with one embodiment of this invention, in a roll-feeder having saddles for receiving ends of a mandrel of a mandrel-mounted roll in a production position, a loader for lifting the ends between a loading position and the production position is disclosed, comprising hook means for engaging the ends, and actuating means for translating the hook means to shift said ends from the loading position to the production position.

In accordance with another embodiment of this invention, a handler for shifting a mandrel supporting a roll between a loading position and a production position is disclosed, comprising: rocker means for supporting the mandrel in the loading position and the production position; and rotating means for rotating the rocker means.

In accordance with a further embodiment of this invention, in a printing process, a method for loading a mandrel supporting a roll from a lower loading position to a higher production position is disclosed, comprising the step of rocking the mandrel from the loading position to the production position.

The foregoing and other objects, features and advantages will be apparent from the folowing, more particular, description of the preferred embodiments of the invention, as illustrated in the accompanying drawings.

THE SPECIFICATION

The invention provides a means and method for precisely loading a heavy, bulky roll of paper into a roll-feeder for a printing press.

Figure 1:
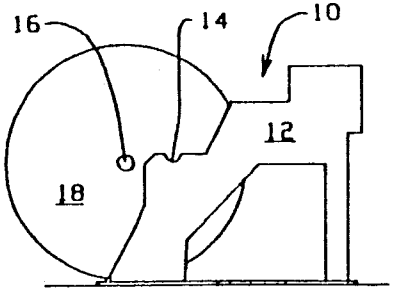
FIG. 1 is an end elevation of a roll-feeder for a printing press, as is old in the art.

FIG. 1 illustrates one end of a typical roll-feeder for a printing press, illustrated generally by 10. Such roll-feeders are well-known in the prior art, The feeder 10 utilized a frame 12, which defined an opposed pair of saddles 14 adapted to rotatably support ends of a mandrel 16. The mandrel 16 mounts a roll of paper 18. The roll 18 is shown in a loading position, with the mandrel 16 resting below the saddles 14. From the loading position, the roll 18 had to be lifted up and into the press 10 before lowering the mandrel 16 into the saddles 14. The saddles 14 constitute the production or uncoiling position for the mandrel 16.

Figure 2:
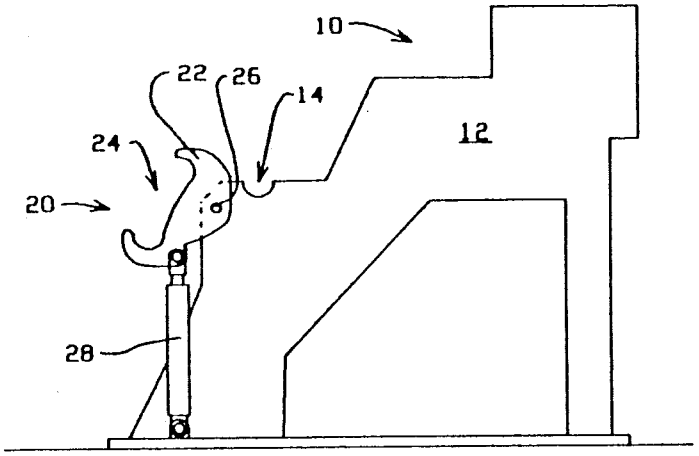
FIG. 2 is an end elevation of a roll-feeder equipped with a roll-loader, with the loader disposed to load a paper roll.

FIG. 2 illustrates the feeder 10, with a loader 20 mounted to manipulate the mandrel 16. The loader 20 incorporates rocking plates 22, respectively positioned adjacent to the saddles 14. The rocking plates 22 each define a concavity 24 in the outer, upper edge. The rocking plate 22 is mounted to the frame 12 by pivot 26, which inherently defines a pivot center for each of the plates 22. Pin-mounted double-acting hydraulic cylinders 28 connect to the frame 12 and the rocking plates 22. The cylinders 28 function as rotating means for rotating the plates 22 about the pivots 26, and are actuated by a hydraulic power pack, which is omitted for clarity.

Figure 3:
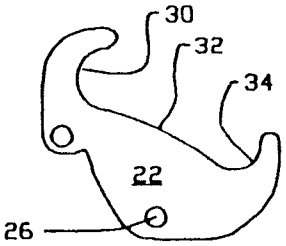
FIG. 3 is an enlarged detail of the rocking hook of the loader of FIG. 2.

FIG. 3 illustrates an enlarged view of the rocking plate 22. The concavity 24 defines a hook pocket 30, a cam surface 32, and a stop pocket 34. The cam surface 32 is specifically contoured to lift the mandrel 16 over and about obstructions provided by the frame 12 or saddles 14 between the positions where the hook pocket 30 lifts the mandrel 16 and the stop pocket 34 places the mandrel 16 in the saddles 14.

Referring further to FIG. 2, hook pocket 30 is located directly below the mandrel 16 when the roll 18 is placed in the loading position as shown in FIG. 1. The hook pocket 30 functions as lifting means or lifting hook means for engaging and lifting the ends of the mandrel 16.

Figure 4:
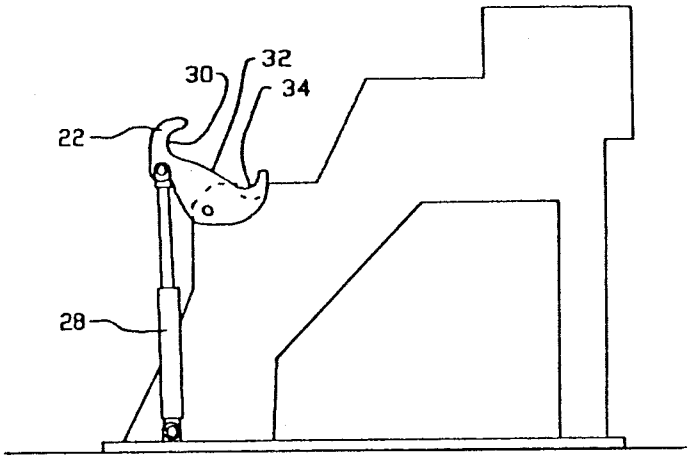
FIG. 4 is an end elevation of a roll-feeder and the roll-loader of FIG. 2, with the rocking hook of the loader between the loading and uncoiling positions.

FIG. 4 shows the loader 20 in the process of lifting and translating the mandrel 16 and supported roll 18. The rocking plates 22 function as rocker means for supporting the mandrel 16 in both the loading position and the production position. The cylinders 28 operate in conjunction with the pivots 26 as rotating means for rotating the plates 22. As the cylinders 28 extend, the rocking plates 22 rotate about the pivots 26. As the rotation of the rocking plates 22 begins, the hook pockets 30 engage the mandrel 16. As the rocking plate 22 rotatin continues, the mandrel 16 slides or rolls from the hook pocket 30 across the cam-surface 32. The cam surface 32 is upwardly convexed to lift the mandrel 16, to specifically lift the mandrel 16 above the upper limits of the saddles 14 as defined by the adjoining frame 12.

As the cylinder 28 nears full extension, the mandrel 16 completes its travel across the cam surface 32 to engage the stop pocket 34. The stop pocket 34 functions as stop means for engaging the mandrel 16 at the production position. In this position the stop pockets 34 function as lowering means for lowering the mandrel 16 directly into the saddles 14 as they are defined by the frame 12.

Figure 5:
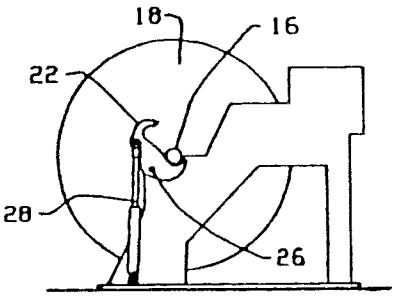
FIG. 5 is an end elevation of a roll-feeder and the roll-loader of FIG. 2, with the rocking hook of the loader having fully released the paper roll in the uncoiling position.

As shown more fully in FIG. 5, once the cylinder 28 has fully extended, the rocking plates 22 have been rotated to the limit about the pivot 26. The mandrel 16 has been placed in the saddles 14, and has been fully released from the stop pocket 34 of the rocking plate 22. At this stage, the roll 18 has been easily loaded into the feeder 10 and roll 18 can be uncoiled into its path throught the printing press.

When it is necessary to remove the mandrel 16 and remaining portion of the roll 18, the cylinder 28 is retracted. As the cylinder 28 retracts, the stop pocket 34 of the rocking plate 22 lifts upward, engaging the ends of the mandrel. Continuted retraction of the cylinders 28 again causes the mandrel 16 to translate across the cam surface 32. Completion of the retractions of the cylinders 28 results in the mandrel 16 coming to rest in the hook pocket 30.

While the invention has been particularly described with reference to the preferred embodiments thereof, it will be understood by those skilled in the art that the foregoing and other changes in form and detail may be made therein without departing from the spirit and scope of the invention.

We claim:

1. In a roll-feeder having saddles for receiving the ends of a mandrel of a mandrel-mounted roll, means for moving said mandrel-mounted roll to a production position including a loader for elevating and translating said mandrel-mounted roll between a loading position and said production position with a single uni-directional motion, comprising:

rocker plates each mounted about a pivot center;

rotating means for rotating said rocker plates about said pivot centers, said rotating means consisting of a single hydraulic cylinder for each of said ends, said hydraulic cylinders rotating said rocker plates about said pivot centers in said single uni-directional motion;

said rocker plates each having a hook pocket for engaging one of said ends at said loading position;

said rocker plates each including a stop pocket for lowering one of said ends into said saddles, one of said rocker plates each having an upwardly convexed cam surface lying between said hook pocket and said stop pocket for elevating and translating a respective one of said ends above and then into its respective saddle.

2. A loader in accord with claim 1, wherein said each of pivot centers lies between one of said hook pockets and one of said stop pockets.

3. In a printing process, a method for loading a mandrel supporting a paper roll from a loading position to a production position with a single uni-directional motion, comprising the steps of:

providing rocker plates each having a hook pocket and a stop pocket connected by an upwardly convexed cam surface;

pivotally mounting said rocker plates;

hooking each end of one of said mandrel at said loading position with one of said hook pockets;

elevating said mandrel above and away from said loading position by pivoting each of said rocker plates with a single hydraulic cylinder;

further elevating and translating said mandrel by moving said mandrel ends over said upwardly convexed cam surfaces;

catching said mandrel ends in said stop pockets at an end of said upwardly convexed cam surface; and lowering said stop pockets and said mandrel ends to said production position.

4. A method in accord with claim 3, further comprising the step of rotating each of said hooks, and said cam surfaces and said stop pockets about a pivot.

* * * * *